US008087388B2

(12) United States Patent
Kobayashi et al.

(10) Patent No.: US 8,087,388 B2
(45) Date of Patent: Jan. 3, 2012

(54) WATER HEATER

(75) Inventors: Toshihiro Kobayashi, Nagoya (JP); Hiroshi Oda, Nagoya (JP)

(73) Assignee: Paloma Indusrties, Limited, Nagoya (JP)

( * ) Notice: Subject to any disclaimer, the term of this patent is extended or adjusted under 35 U.S.C. 154(b) by 408 days.

(21) Appl. No.: 12/107,972

(22) Filed: Apr. 23, 2008

(65) Prior Publication Data

US 2008/0264355 A1 Oct. 30, 2008

(30) Foreign Application Priority Data

Apr. 27, 2007 (JP) ..... 2007-119826

(51) Int. Cl.
*F24H 1/18* (2006.01)

(52) U.S. Cl. ..... 122/18.1; 122/32; 122/13.01

(58) Field of Classification Search ..... 122/18.1, 122/32, 14.31, 14.2, 13.01, 14.1, 13.3, 14.21, 122/14.22, 14.3, 15.1, 16.1, 17.1, 17.2, 18.2, 122/18.3, 18.31, 18.4, 18.5, 19.1, 19.2
See application file for complete search history.

(56) References Cited

U.S. PATENT DOCUMENTS

| | | | | |
|---|---|---|---|---|
| 1,706,416 | A | 3/1929 | Schwartz | |
| 2,479,042 | A * | 8/1949 | Gaines | 122/17.1 |
| 5,022,352 | A * | 6/1991 | Osborne et al. | 122/17.2 |
| 5,511,516 | A | 4/1996 | Moore, Jr. et al. | |
| 5,636,598 | A * | 6/1997 | Moore, Jr. | 122/18.3 |
| 6,074,200 | A * | 6/2000 | Bowman et al. | 431/278 |
| 6,554,608 | B1 * | 4/2003 | Bowman et al. | 431/6 |
| 6,561,138 | B2 | 5/2003 | Kobayashi et al. | |
| 6,895,902 | B2 | 5/2005 | Kobayashi et al. | |

FOREIGN PATENT DOCUMENTS

JP 2001-304691 A1 10/2001

* cited by examiner

*Primary Examiner* — Steven B McAllister
*Assistant Examiner* — Seth Greenia
(74) *Attorney, Agent, or Firm* — Burr & Brown

(57) ABSTRACT

The object is to provide a water heater capable of efficiently transmitting radiation heat of a burner to hot water in a hot water storage chamber with improved thermal efficiency. In the water heater, a second restriction part having a shallower depth than a first restriction part is arranged along a peripheral edge of a lower mirror plate of a hot water storage chamber with a protrusion part protruding in a ring shape toward the center side of the lower mirror plate. The protrusion part is further arranged between the first restriction part and the second restriction part, and a burner is positioned so that the burner combustion surface faces the protrusion part.

2 Claims, 2 Drawing Sheets

WATER HEATER

This application claims the entire benefit of Japanese Patent Application No. 2007-119826 filed on Apr. 27, 2007 the entirety of which is incorporated by reference.

BACKGROUND OF THE INVENTION

1. Field of the Invention

The present invention relates to a water heater, especially a hot water storage type water heater, for heating hot water stored in a hot water storage chamber to a predetermined temperature and keeping the temperature.

2. Description of the Background Art

As shown in patent document 1, a conventional hot water storage type water heater includes a hot water storage chamber on the upper side of a cylindrical main body and a combustion chamber. The hot water storage chamber is arranged on an upper side of the cylindrical main body by being closed top and bottom thereof by a mirror plate which has an upward protruded restriction part. The hot water storage chamber has an exhaust passage at a central axis thereof. The combustion chamber includes a burner, which is located on a lower side of the hot water storage chamber. FIG. 3 illustrates a lower portion of the conventional hot water storage type water heater 30 including a hot water storage chamber 31, a lower mirror plate 32, and a combustion chamber 33. When a burner 34 is combusting in the combustion chamber 33 and a high temperature combustion gas goes up through an exhaust passage 35, hot water in the hot water storage chamber 31 can be heated and kept at a predetermined temperature. Numeral 37 donates an air inlet which is drilled around a lower part of a stand 36 on which the burner 34 is set and communicating with the outside. The inlet 37 is used for taking in air for combustion in.

Patent document 1: Japanese Unexamined Patent Publication No. 2001-304691

SUMMARY OF THE INVENTION

The burner 34 disclosed in the patent document 1 is a Bunsen burner. In the disclosed burner, as a large combustion space is required in the combustion chamber 33, a distance between the burner 34 and the lower mirror plate 32 is long. Therefore, radiation heat from the burner 34 is emitted toward an inner surface of the combustion chamber 33 as illustrated with wavy lines and is not efficiently transmitted to the lower mirror plate 32. Thus, the radiation heat does not contribute to heating hot water in the hot water storage chamber 31.

An object of the present invention is to provide a water heater capable of reducing such an energy loss, efficiently transmitting radiation heat from a burner to hot water in a hot water storage chamber, which improves thermal efficiency.

In order to achieve the above-described object, a first aspect of the invention is a water heater, in which a cylindrical main body, a hot water storage chamber arranged above a mirror plate which includes upwardly protruding restriction part in the main body, a combustion chamber including a burner below the mirror plate, a second restriction part having a shallower depth than a restriction part of a mirror plate partially arranged along a peripheral edge of the mirror plate, a protrusion part protruding in a ring shape toward a center side of the mirror plate formed between the restriction part and the second restriction part, and the burner is provided so as to face the protrusion part.

A second aspect of the invention is in addition to the first aspect of the invention, a water heater, where a burner is an all primary air burner having a cylindrical burner head in which a side surface thereof is a combustion surface, an upper end of the burner head is positioned above the protrusion part of the mirror plate to make the side surface of the burner face the protrusion part, which improves the efficiency of transmitting radiation heat to hot water in a hot water storage chamber.

According to the first aspect of the invention, radiation heat of the burner can be efficiently transmitted to hot water in the hot water storage chamber in addition to a combustion gas of the burner heating the hot water storage chamber. Thus, energy loss can be reduced and thermal efficiency can be improved.

According to the second aspect of the invention, in addition to the first aspect, the burner is arranged closer to the mirror plate to make a whole periphery of the burner head to face the protrusion part, so that radiation heat can be efficiently transmitted to hot water in the hot water storage chamber.

BRIEF DESCRIPTION OF THE DRAWINGS

FIG. 2 are explanatory views of a lower mirror plate, where

DETAILED DESCRIPTION OF THE INVENTION

Embodiments of the present invention will be described below with reference to the drawings.

Figure 1:
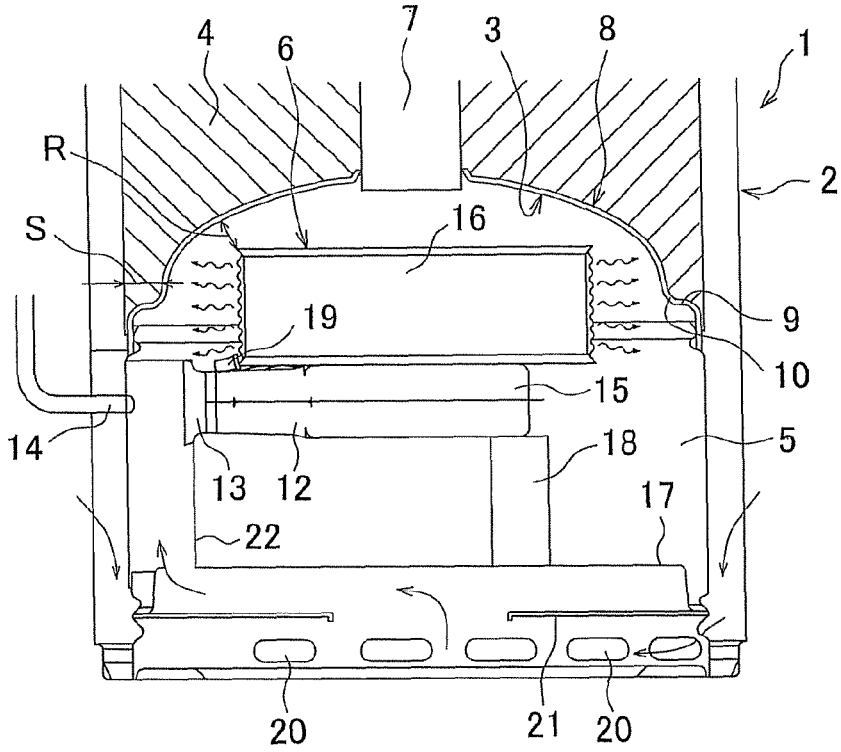
FIG. 1 is an explanatory view of a lower portion of a water heater.

FIG. 1 is an explanatory view of a lower portion showing an example of a water heater. A water heater 1 includes a hot water storage chamber 4 and a combustion chamber 5. The hot water storage chamber 4 is provided on an upper side of a cylindrical main body 2 and upper and lower parts of the hot water storage chamber 4 are closed with an upper mirror plate (not illustrated) and a lower mirror plate 3. The combustion chamber 5 has a burner 6 below the hot water storage chamber 4. In addition, the water heater 1 includes a water supply pipe for supplying water into the hot water storage chamber 4, and a hot water supply pipe on an upper side of the hot water storage chamber 4 for taking out hot water from the hot water storage chamber 4 (both pipes are not illustrated). The hot water storage chamber 4 includes an exhaust pipe 7 at a central axis of the chamber, and the exhaust pipe 7 penetrates through the hot water storage chamber 4 to be protruded above the main body 2. Exhaust combustion gas generated in the combustion chamber 5 is led to the outside of the main body 2 through the exhaust pipe 7. A baffle plate (not illustrated) having a spiral exhaust passage is provided in the exhaust pipe 7.

Figure 2A:
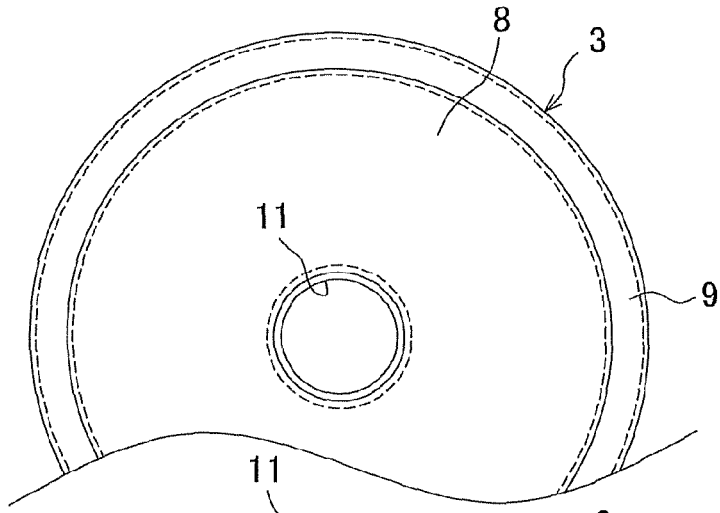
FIG. 2A illustrates a plane surface.
Figure 2B:
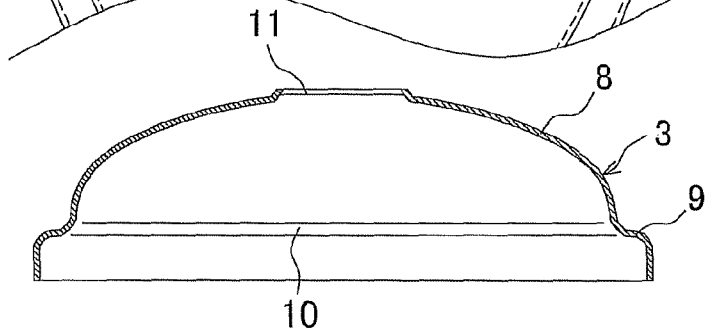
FIG. 2B illustrates a cross section.
Figure 3:
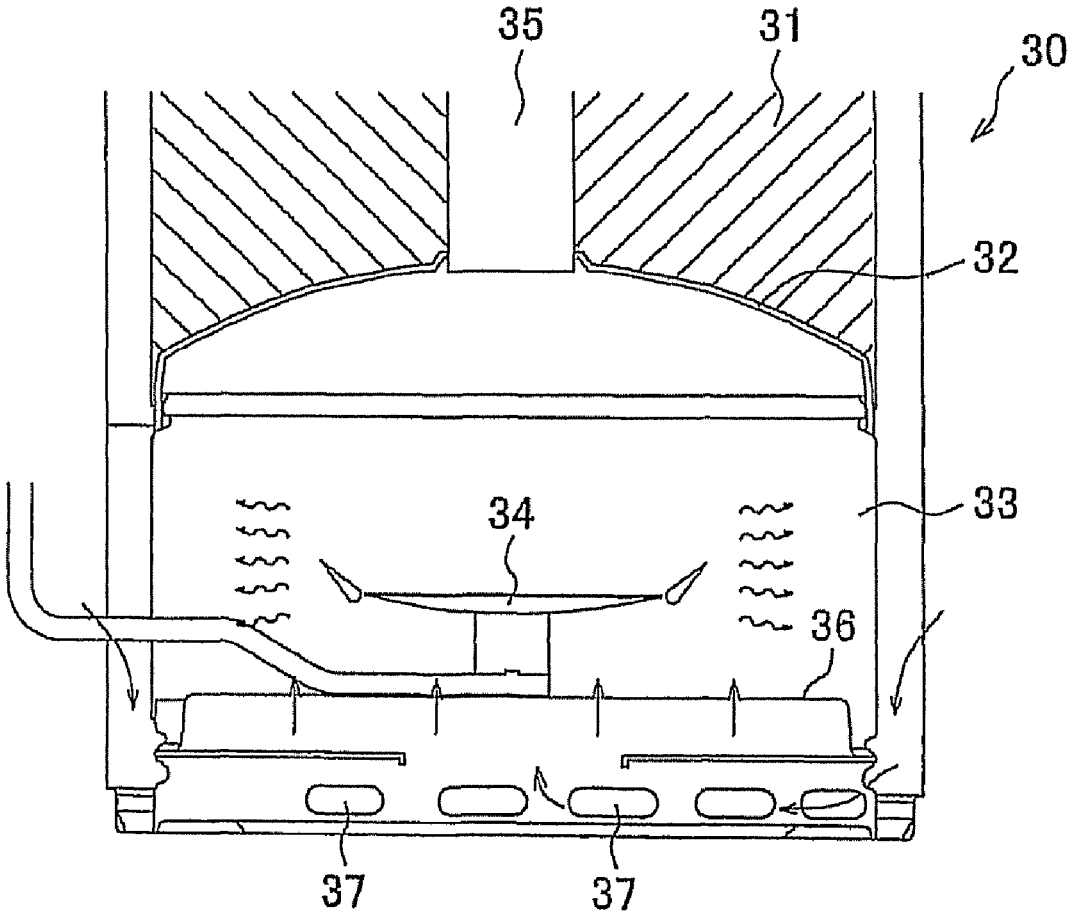
Fig. 3 PRIOR ART
FIG. 3 is an explanatory view of a lower portion of a conventional hot water storage type water heater.

The lower mirror plate 3 is a metal plate having an upwardly protruding restriction part 8. As illustrated in FIG. 2A, a second restriction part 9 having a shallower depth than that of the restriction part 8 is partially formed along a peripheral edge of the lower mirror plate 3. A protrusion part 10 in a ring shape protruding toward a center side of the lower mirror plate 3 is arranged between the restriction part 8 and the second restriction part 9. A numeral 11 denotes a penetration hole of the exhaust pipe 7.

By means of the protrusion part 10, a ring-shaped hot water storage space S with relative thickness in a radius direction is provided at a lower end of the hot water storage chamber 4. As the hot water storage space S is provided, a capacity in the hot water storage chamber 4 becomes larger than that of a conventional water heater and a large amount of hot water in a portion facing a burner head 16 can be stored, as described later.

On the other hand, the burner 6 is an all-primary air burner taking in the most air required for combustion as primary air. The burner 6 includes a burner main body 12 and a cylindrical burner head 16. The burner main body 12 has a throat part 13 facing a gas nozzle 14 whose forefront is protruded toward the inside of the combustion chamber 5. The cylindrical burner head 16 is placed on a mixing chamber 15 at a forefront of the burner main body 12 and works as a combustion part. The burner 16 is supported on a disk-like placing base 17 provided at a lower part of the combustion chamber 5 using a supporting plate 18 so as to position the burner head 16 at a center of the combustion chamber 5. The numeral 19 denotes a pilot burner. The burner head 16 has a plurality of burner ports on a substantially whole side surface thereof.

Here, the burner 6 is supported by the supporting plate 18 so as to position an upper end surface of the burner head 16 to locate above the projection part 10 of the lower mirror plate 3. In other words, the burner 6 is supported so that the burner head 16 protrudes into a space covered by the lower mirror plate 3 and a side surface of the burner 6 faces a whole periphery of the hot water storage space S. However, if the burner head 16 is positioned too close to the lower mirror plate 3, a passage of combustion gas generated around the burner head 16 between the lower mirror plate 3 and the burner head 16 becomes narrow to increase exhaust resistance. Thus, when the burner 16 is provided, it is desirable that an interval R is always set to be larger than an opening diameter of the exhaust pipe 7, where the interval R is a distance between an inner periphery of a lower surface of the lower mirror plate 3 and an outer periphery of an upper end of the burner head 16 in the radius direction of the burner head 16.

Further, plural air feed ports 20, 20 . . . to take in air for combustion are provided at predetermined intervals in the peripheral direction at a lower peripheral edge of the placing base 17 so as to communicate between inside of the placing base 17 and the outside of the main body 2. The placing base 17 includes a partition plate 21 which has an opening at the center thereof and the placing base 17 is separated by the partition plate 21 into upper and lower parts. On the other hand, while an upper part in the placing base 17 partitioned by the partition plate 21 is kept communicated with the throat part 13 of the burner main body 12, an air passage 22 in the upper and lower direction, which partitions the inside of the chamber combustion 5, is arranged on a gas nozzle 14 side of the combustion chamber 5. Thus, after flowing into the placing base 17 from the air feed port 20 as indicated by an arrow, air from outside passes through the opening of the partition plate 21 and reaches to the air passage 22. Then, the air goes up through the air passage 22 to be introduced into the burner main body 12.

As for the water heater 1 having the above-described configuration when an ignition knob of a controller (not illustrated) externally provided at the main body 2 is pushed, a gas flow passage to a pilot burner 19 is opened so as to ignite the pilot burner 19. When the ignition is detected by a thermocouple (not illustrated), an electromagnetic valve of the gas flow passage is opened and kept open. Thus, when the ignition knob is operated in such a condition so as to open a main gas flow passage, the fuel gas is ejected from the gas nozzle 14 and supplied through the throat part 13 to the burner main body 12. When the gas is ejected, air outside of the main body 12 is taken in through the air feed port 20 and is then led to the burner main body 12 through the inside of the placing base 17, the air passage 22, and the throat part 13. Then, the air is mixed with the fuel gas in the mixing chamber 15 and the mixed gas is supplied to the burner head 16 and is ejected from the burner ports to be combusted. Therefore, combustion is carried out on the whole side surface of the burner head 16.

The high temperature combustion gas generated by combustion at the burner 6 goes up along a lower surface of the lower mirror plate 3, passes through the exhaust pipe 7 provided at the center, and is exhausted outside of the main body 2. By the flow of the combustion gas, hot water in the hot water storage chamber 4 is heated using the lower mirror plate 3 and the exhaust pipe 7.

On the other hand, radiation heat generated by combusting at the side surface of the burner head 16 is radially radiated from the burner head 16 as illustrated with wavy arrows. However, since the whole side surface of the burner head 16 faces the hot water storage space S, the radiation heat is effectively transmitted to hot water in the hot water storage chamber 4 to heat the hot water.

According to the water heater 1 of the above-described embodiment, the second restriction part 9 having a shallower depth than that of the restriction part 8 is partially provided along a peripheral edge of the lower mirror plate 3. The protrusion part 10 protruding in a ring shape toward the center of the lower mirror plate 3 is provided between the restriction part 8 and the second restriction part 9. Further, the burner 6 is provided so as to position the burner head 16 of the burner 6 to face the protrusion part 10. Thus, in addition to the heat by the fuel gas of the burner 6, radiation heat of the burner 6 can be efficiently transmitted to hot water in the hot water storage chamber 4. Therefore, energy loss can be reduced, which improves thermal efficiency.

Particularly, the burner 6 works as an all primary air burner having the cylindrical burner head 16 and a side surface of the burner 6 is a combustion surface and is provided so as to position an upper end of the burner head 16 above the protrusion part 10 of the lower mirror plate 3, and the side surface of the burner head 16 is made to face the protrusion part 10. Thus, the burner 6 can be positioned closer to the lower mirror plate 3 to make a whole periphery of the burner head 16 to face the protrusion part 10. Therefore, the radiation heat can be efficiently transmitted to hot water in the hot water storage chamber 4.

In addition, in a lower mirror plate of the above-described embodiment, a protrusion part is in a configuration with a combination of circles. However, the protrusion part can be configured by a combination of surfaces.

Furthermore, a burner is not limited to a burner having a cylindrical burner head as a combustion part, and a burner may have burner ports on a peripheral surface of a disk-like burner head. In other words, the burner may be appropriately changed as long as the burner being faced a protrusion part of a mirror plate. Further combustion air may be compulsively supplied using a fan. A Bunsen burner may also be used depending on a size of a combustion chamber, a shape of a mirror plate, or the like.

What is claimed is:

1. A water heater comprising:

a cylindrical main body;

a hot water storage chamber arranged above a mirror plate that includes an upwardly protruding first restriction part having a first predetermined length in the axial direction of the water heater, wherein the upwardly protruding first restriction part is continuously inwardly tapered towards a center axis of the water heater;

the hot water storage chamber positioned above the mirror plate and in the cylindrical main body;

a combustion chamber having a burner positioned below the mirror plate such that hot water in the hot water storage chamber is heated by combustion of the burner; and a second restriction part protruding outwardly in a curved ring shape and having a second predetermined length in the axial direction of the water heater that is less than the length of the first restriction part, wherein the second restriction part includes, a peripheral edge of the minor plate that smoothly merges with and abuts an inside cylindrical surface of the cylindrical main body, and a protrusion part protruding inwardly in a ring shape toward a center side of the mirror plate, said protrusion part continuously extending between the first restriction part and said peripheral edge;

wherein the burner is positioned such that a combustion surface of the burner directly radially faces said protrusion part and said peripheral edge.

2. The water heater according to claim 1, wherein:

the burner is an all-primary air burner having a cylindrical burner head, wherein a side surface of the cylindrical burner is said combustion surface;

the burner is arranged so that an upper end edge of the burner head is located above said protrusion part of the mirror plate, and the side surface of the burner is positioned such that said combustion surface of the burner faces said protrusion part and said peripheral edge.

* * * * *